US006796379B1

(12) United States Patent
Martin

(10) Patent No.: US 6,796,379 B1
(45) Date of Patent: Sep. 28, 2004

(54) DRILLING WASTE HANDLING

(76) Inventor: Andrew Martin, Gaia Lodge, Blairs, Aberdeen (GB), AB15 5YT ( * ) Notice: Subject to any disclaimer, the term of this patent is extended or adjusted under 35 U.S.C. 154(b) by 77 days.

(21) Appl. No.: 10/070,325

(22) PCT Filed: Sep. 4, 2000

(86) PCT No.: PCT/GB00/03396

§ 371 (c)(1),
(2), (4) Date: Jul. 23, 2002

(87) PCT Pub. No.: WO01/18352

PCT Pub. Date: Mar. 15, 2001

(30) Foreign Application Priority Data

Sep. 4, 1999 (GB) ..... 9920819

(51) Int. Cl.[7] ..... E02D 23/02
(52) U.S. Cl. ..... 166/356; 175/66; 405/210
(58) Field of Search ..... 106/356; 175/66, 175/5; 405/210

(56) References Cited

U.S. PATENT DOCUMENTS 3,552,131 A * 1/1971 Mott et al. ..... 405/210
5,820,300 A * 10/1998 Sonoda et al. ..... 405/188
5,899,637 A * 5/1999 Blanchard et al. ..... 405/210
6,293,217 B1 9/2001 Savage et al. ..... 114/256
6,345,672 B1 2/2002 Dietzen ..... 275/66

* cited by examiner

*Primary Examiner*—William Neuder
(74) *Attorney, Agent, or Firm*—Derek H. Maughan; Dykas, Shaver & Nipper

(57) ABSTRACT

A method and an apparatus for storage and transport of drilling waste is provided. A number of storage containers (12) are anchored to the sea bed by means of anchors (15) and cables (13). The location of the containers (12) is marked with buoys (17). The containers (12) are of adjustable buoyancy, and are arranged to remain below the surface of the sea. Drilling waste is macerated on board a drilling vessel (18), and pumped via conduits (20) into the containers (12). Once the containers (12) are full, a tug (22) collects the containers (12) and transports them to an onshore waste recycling facility, while empty tanks are returned to the drilling vessel (18) to be reused. The containers (12) may be arranged to agitate stored waste, either by means of an internal agitator, or by virtue of fins or paddles mounted on the containers (12), to rotate the containers in response to sea currents.

32 Claims, 2 Drawing Sheets

DRILLING WASTE HANDLING

The present invention relates to a method and an apparatus for storage and transport of drilling waste, such as drill cuttings and similar substances as produced in the course of marine drilling operations.

In drilling operations, particularly in the drilling of oil and gas wells, drilling mud is often pumped downhole for a number of different purposes, such as lubrication of the drill string, prevention of corrosion, and transport of drill cuttings uphole.

Drilling muds may be oil or water-based, although oil-based muds are preferred in lower sections of bore, and are also generally less costly than water-based muds.

Once the drilling mud is returned to the surface, it is passed through screens or other filtering arrangements to separate the drill cuttings from the mud. The drill cuttings are collected and, in offshore operations, stored on the drilling platform or vessel before being transported onshore for processing. Once onshore, oil and moisture are separated from the cuttings, the cuttings then being sent for landfill while the oil is recycled. Alternatively, the cuttings may be utilised as road building material or as fertiliser filler. It was formerly the practice to dump the cuttings at sea; however the presence of contaminants in the cuttings creates environmental problems. Further, in many jurisdictions there is legislation pending or in place which now only permits "zero discharge" drilling operations; that is, dumping of untreated cuttings is prohibited.

Prior to being transported onshore for processing, drilling waste is presently stored in skips or other containers, of typically 5 tonnes capacity, on deck of the drilling platform or vessel. As a typical drilling operation may produce up to 800 tonnes of drilling waste, many such containers will be necessary. Not only does this take up valuable deck space, but if, for example, inclement weather should prevent transport vessels from removing filled containers from a drilling platform, drilling operations may have to be suspended for a period until the containers are removed.

Furthermore, the loading of skips or containers onto a transport vessel must typically be done by crane, one skip at a time. This is a slow process, and requires many crane movements, thereby increasing the risk of accidents occurring.

An alternative approach is to macerate drill cuttings and store them on or below the deck of the drilling platform or vessel. The macerated cuttings are subsequently pumped onto a transport vessel. However, such macerated cuttings are generally too fine to be handled easily in conventional cuttings processing facilities; and while being stored on the platform must be maintained in circulation, to avoid settling out of the cuttings, which would prevent pumping onto a transport vessel.

Furthermore, all of these known approaches are heavily dependent on weather conditions being suitable to permit transport vessels to approach the offshore facility and to permit transfer of materials or containers between the vessel and the facility.

In some areas, for example, the eastern Atlantic Ocean to the west of the Shetland Isles, it has been estimated that in winter some 65–70% of drilling costs are weather related. Reduction of the reliance on favourable weather conditions would therefore be of considerable benefit.

It is among the objects of embodiments of the present invention to obviate or alleviate these and other disadvantages of the prior art. In particular, in the present invention, the storage of drilling waste is not dependent on deck area of the drilling platform; and the method is far less susceptible to adverse weather conditions than the prior art.

According to a first aspect of the present invention, there is provided a method of storing and transporting drilling waste produced in an offshore drilling operation, the method comprising the steps of:

providing a movable container for receiving drilling waste;

securing the container in a position below sea-level;

connecting the container to a drilling platform or vessel; and conveying drilling waste from the platform or vessel to the container.

The present invention does not require the container to be located on the drilling platform or vessel, so releasing the method from many of the constraints of the prior art. In particular, the storage of drilling waste is not dependent on using deck area of the drilling platform; and the method is less susceptible to adverse weather conditions than the prior art.

In a preferred embodiment, at least two containers are provided. Preferably, the containers are together of a volume sufficient to contain the drilling waste from a complete drilling operation. Most preferably, each container is capable of holding at least 500 tonnes of drilling waste.

Preferably, the method further comprises the step of agitating the drilling waste within the container. Conveniently this may be, achieved by rotating or otherwise moving the container in the water; or by providing an agitator within the container. The container may be provided with external fins or the like which tend to rotate or move the container in response to sea currents. This movement prevents waste from settling, and possibly unbalancing the container; settled waste may also be more difficult to remove from the container.

Preferably, the method further comprises the steps of:

releasing the container from its position; and transporting the container to a drilling waste processing facility.

The released container may have its buoyancy increased, such that the container rises in the water to a position at or closer to the sea surface.

As the container is remains in the water, transportation of the container requires few if any lifting or crane operations. Again, this reduces the vulnerability to adverse weather conditions of the transport process.

Preferably the container is positioned spaced from the platform or vessel. This facilitates installation of the container, as the tug, work boat or other vessel utilised to transport the container may be manoeuvred with less risk of coming into contact with the platform or vessel, and facilitates installation of the container in adverse weather conditions.

Preferably, the container is secured in position by an anchoring means attached to the seabed. Conveniently, the anchoring means may be one or more anchors, which may be conventional anchors or suction anchors, or may be a base sitting on or anchored to the sea bed and configured so as to receive a container. Alternatively, or in addition, the container may be of adjustable buoyancy, and may be ballasted to remain at a predetermined depth in the sea. Most preferably, the container is secured such that it lies between 50 to 150 feet beneath the sea surface, and is thus relatively unaffected by weather conditions. Of course in shallow water, or in situations where weather conditions are relatively benevolent, the container may be maintained at a lesser depth, and even may have portions extending above the surface.

Preferably, the container is connected to the drilling platform or vessel by means of a conduit, and preferably by means of a dual conduit. Preferably, the conduit is a flexible hose. Most preferably, a plurality of flexible hoses are provided. The flexible hoses will be constructed to withstand anticipated weather conditions, while provision of a plurality of hoses provides for redundancy, so that drilling operations may continue if one of the hoses is temporarily blocked, disconnected or damaged.

Preferably, the method further comprises the step of conveying drilling waste, from the platform to a smaller volume holding tank on the platform prior to conveying the waste to the container. This additional step facilitates pre-storage processing of the drilling waste prior to storage. Alternatively, the drilling waste may be transported directly to the container.

Preferably, the method further comprises the step of macerating the drilling waste prior to conveying the waste to the container. This ensures that the solids in the waste are of a substantially uniform size, so facilitating conveyance to the container, and a reduced risk of blockage. However, the degree of maceration is preferably selected such that the resulting slurry is of sufficient viscosity to facilitate subsequent handling and processing.

Preferably, the method further comprises the step of determining the liquid, water or oil content and then adjusting the liquid or oil content to facilitate handling and maintaining solids in suspension. Thus, for particularly "wet" waste it may be desirable to extract oil is from the waste prior to conveying the waste to the container, however this is unlikely to be commonplace. This would enables at least some of the oil to be recycled and reused without the need to transport the waste onshore, and also reduces the volume of waste it is necessary to store. More likely, the method will further comprise the step of adding oil to the drilling waste prior to conveying the waste to the container; the oil may be used or recycled drilling fluid. This has the effect of "slurrifying" relatively dry waste, which generally makes the waste easier to convey to the container and easier to process once onshore.

Preferably, the method further comprises the step of agitating the contents of the container whilst it is being transported to the recycling facility. This prevents the waste from settling out, which increases the difficulty of recycling.

Preferably, the method further comprises the steps of:

providing an additional container; and maintaining at least one container at the platform or vessel.

This enables drilling waste to be received on a continuous basis, so reducing the likelihood that drilling operations will have to be suspended due to lack of storage. In the preferred embodiment, two containers are maintained at the platform or vessel during each drilling operation.

According to a second aspect of the present invention, there is provided an apparatus for use in storage and transport of drilling waste, the apparatus comprising movable containment means for containing drilling waste; securing means for releasably securing the container in a position below sea level; and connection means for connecting the container to a drilling platform or vessel.

Preferably, the containment means comprises a container or other closed vessel. The container may be of reinforced concrete construction or a steel fabrication; preferably the container is fabricated of steel in a double skin construction. Any suitable material may however be used, including flexible fabrics or other materials.

Preferably, the container is capable of holding at least 500 tonnes of drilling waste.

Preferably, the securing means comprises an anchor means for attaching the container to the sea bed. The anchor means may comprise a base to be located on the seabed, configured so as to receive and retain at least one container; alternatively or in addition the anchor means may comprise one or more anchors for attachment to the container and the sea floor.

Preferably, the container comprises agitation means, to enable the contents of the container to be agitated. The agitation means may comprise an internal rotating paddle; or may comprise external fins mounted on the container, such that the container rotates in response to sea currents.

Preferably, the container is of adjustable buoyancy; as the container is filled with drilling waste, the buoyancy may be adjusted to maintain the container at a substantially constant level in the water. Preferably, the container comprises a double skin, with a cavity between the skins which may be filled with air or seawater as desired, in order to adjust buoyancy.

Preferably, the connection means comprises a flexible conduit for conveying drilling waste, and most preferably a plurality of flexible conduits.

Preferably, the apparatus further comprises a holding tank for holding drilling waste prior to conveying the waste to the container. Preferably, the holding tank includes a macerator. The holding tank may include a press for extracting oil or water from the drilling waste, but is more likely to include means for adding liquid, and in particular oil, to the drilling waste.

These and other aspects of the present invention will now be described, by way of example only, and with reference to the accompanying drawings, in which.

Figure 1:
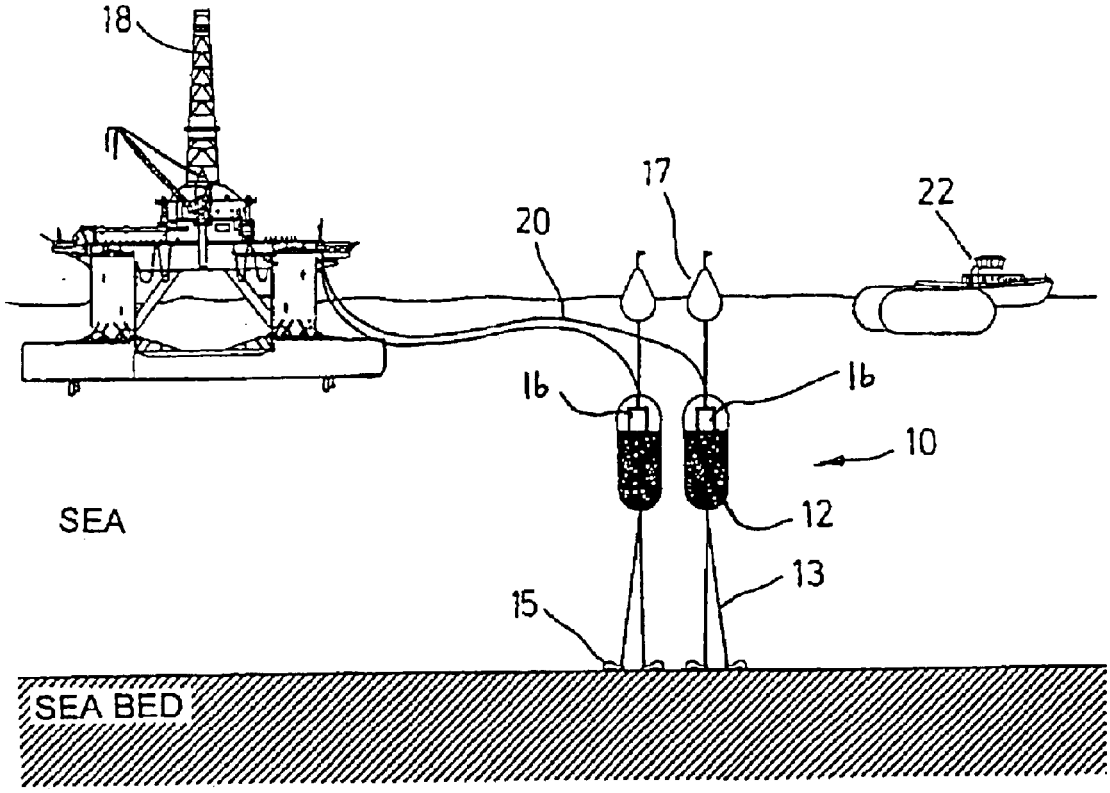
FIG. 1 illustrates an apparatus for storage and transport of drilling waste in accordance with a first aspect of the present invention.

Referring first of all to FIG. 1, this illustrates an apparatus for storage and transport of drilling waste according to one aspect of the present invention, for use in deep water applications. The apparatus 10 includes two containers or flasks 12, each capable of storing up to 500 tonnes of drilling waste. Of course, a plurality of smaller containers may be provided in an alternative arrangement. The containers 12 are tethered to the seabed by means of cables 13 and anchors 15. The location of the containers 12 is marked by buoys 17 tethered to each container 12.

Figure 2:
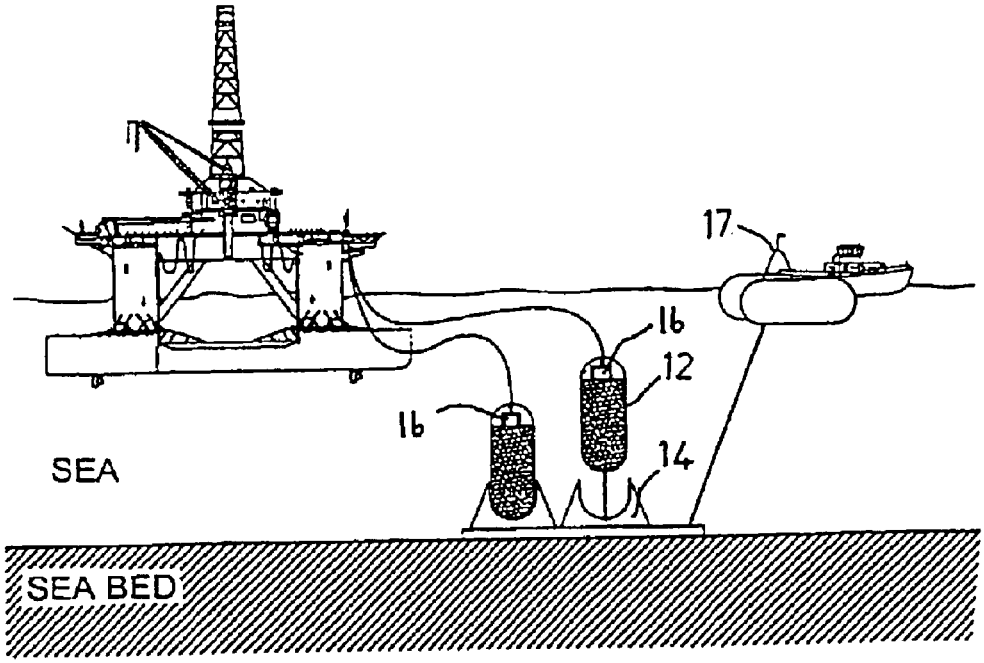
FIG. 2 illustrates an alternative embodiment of an apparatus for storage and transport of drilling waste.

In an alternative embodiment suitable for shallow water applications, shown in FIG. 2, the containers 12 are received and retained in a concrete receiving base 14 located on the sea floor. The location of the base 14 is marked by a buoy 17.

The containers 12 are connected to a drilling platform 18 via a number of flexible dual conduits 20 which convey drilling waste from the drilling platform 18 to the container 12. The containers 12 also contain agitation means 16.

The operation of the apparatus 10 will now be described. A tug 22 approaches towing an empty container 12. The container may be towed by any suitable tug; no particular modifications are necessary to the tug. The container 12 comprises a double skinned steel wall defining a cavity, which cavity is filled with seawater in order to ballast the container 12. Once appropriately ballasted, the container 12 either sinks to the sea floor, and is secured in the base 14 and coupled to the platform 18 via the conduits 20, as shown in FIG. 2, or is anchored to the seabed and floats midwater, typically at a depth of 50 to 150 feet, as shown in FIG. 1. As the containers 12 lie beneath the sea surface, they are relatively insensitive to adverse weather conditions.

As drill cuttings are brought to the surface during the course of a drilling operation, the cuttings are passed into a holding tank (not shown), where the cuttings may be macerated, oil removed or added to the waste to provide a desired ratio of solids to oil or liquid, prior to the slurry-like waste being passed via conduit 20 into the container 12.

Once the container 12 has been filled, the tug 22 returns. The full container 12 is deballasted, by replacing the water in the skin cavity with air, and released from the base 14 or anchors 15, to rise to the sea surface. The tug 22 then tows the full container 12 to a recycling facility onshore, rotating the container 12 as it does so, in order to avoid settling of the contents.

Figure 3:
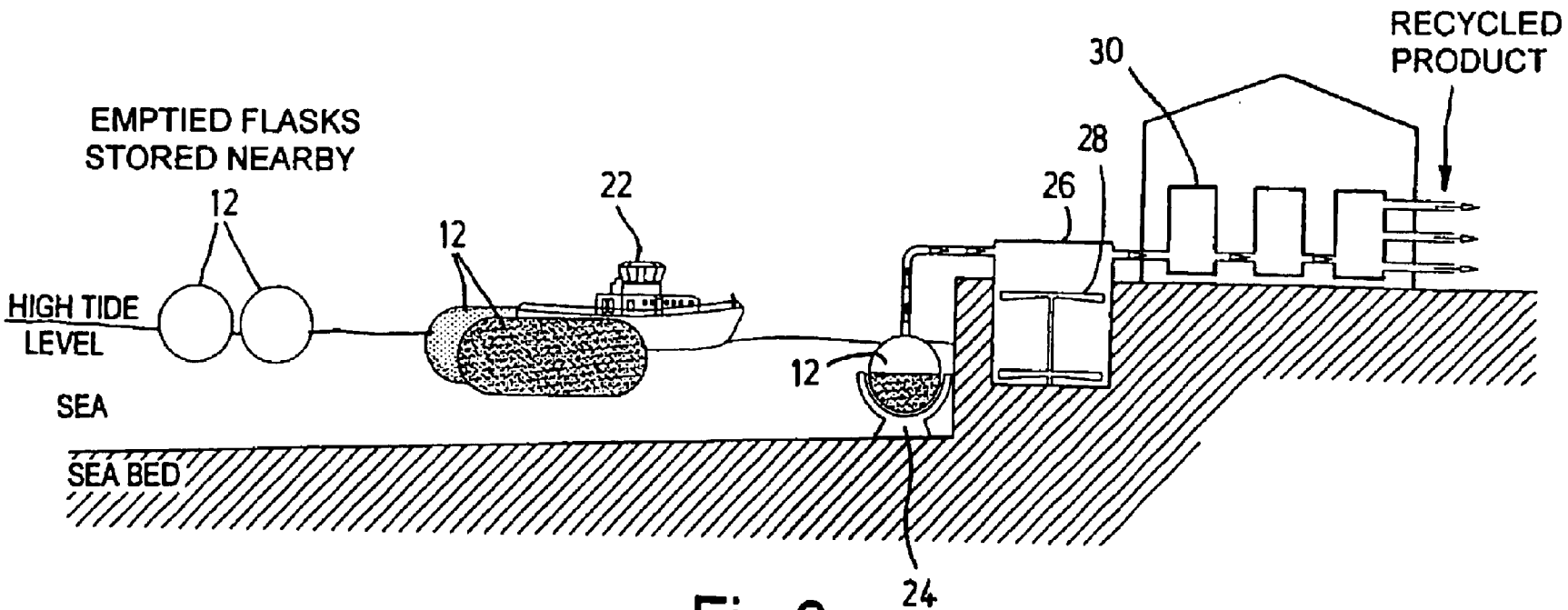
FIG. 3 illustrates the recycling of drilling waste as stored and transported in the apparatus of FIG. 1 or FIG. 2.

The recycling process is illustrated in FIG. 3. The tug 22 moors a full container 12 above a receiving cradle 24 located on the sea floor at the dockside. As the tide falls, the container 12 is located and fixed in the cradle 24. The container 12 is then connected to a holding tank 26 onshore, and the contents of the container 12 pumped into the tank 26. The container may be arranged to discharge into any land-based facility; no specialised arrangements are necessary. The holding tank 26 also contains an agitator 28 in order to prevent settlement of the waste. The container 12 may be removed from the cradle 24 once it has been emptied of waste, and reused. The waste is then passed from the holding tank 26 through a series of processing tanks 30, which may for example contain settling tanks, separators, macerators, presses and the like, in order to process and recycle the waste.

The foregoing is for illustrative purposes only, and it will be clear to those of skill in the art that various modifications and improvements may be made to the apparatus and method herein described without departing from the scope of the invention. For example, it may be preferred that two containers remain on site during drilling operations, to ensure that drilling operations may be continuous.

In other aspects of the invention, where weather is conditions permit, the containers may be mounted in or coupled to barges or other vessels anchored in close proximity to the platform, or the waste material may be contained within the hold of a barge or the like.

What is claimed is:

1. A method of storing and transporting drilling waste produced in an offshore drilling operation, the method comprising the steps of:

providing a moveable container of adjustable buoyancy for receiving drilling waste;

securing the container;

connecting the container to a drilling platform or vessel; and conveying drilling waste from the platform or vessel to the container.

2. The method of claim 1 further comprising the steps of:

releasing the container from its position; and transporting the container to a drilling waste recycling facility.

3. The method of claim 2 wherein at least two containers are provided.

4. The method of claim 1 further comprising the step of agitating the drilling waste within the container.

5. The method of claim 4 wherein the agitation step comprises rotating or otherwise moving the container in the water.

6. The method of claim 1 wherein the container is provided with external fins or the like which tend to rotate or move the container in response to sea currents.

7. The method of claim 1 comprising the step of securing the container on position by anchoring the container to the seabed.

8. The method of claim 1 further comprising the step of adjusting the buoyancy of the container, to maintain the container at a substantially constant depth.

9. The method of claim 1 comprising the step of releasably fixing the container to the sea floor.

10. The method of claim 1 further comprising the step of conveying drilling waste to a smaller volume holding tank on the platform, prior to conveying the waste to the container.

11. The method of claim 1 comprising the step of macerating the drilling waste prior to conveying the waste to the container.

12. The method of claim 1 further comprising the step of determining selected parameters of the waster prior and then adjusting said parameters before conveying the waste to the container.

13. The method of claim 1 further comprising the step of adding oil to the drilling waste prior to conveying waste to the container.

14. The method of claim 1 further comprising the step of agitating the contents of the container whilst the container is transported to a treatment facility.

15. The method of any preceding claim further comprising the steps of:

providing an additional container; and maintaining at least one container at the platform vessel.

16. The method of claim 1 wherein the container is made of flexible fabric.

17. An apparatus for use in storage and transport of drilling waste, the apparatus comprising a moveable container of adjustable buoyancy for containing drilling waste; securing means for releasably securing the container, and connection means for connecting the container to a drilling platform or vessel.

18. The apparatus of claim 17 wherein the securing means comprises an anchor means to be attached to the sea bed.

19. The apparatus of claim 18 wherein the anchor means comprises a base to be located on the seabed, configured so as to receive and retain at least one container.

20. The apparatus of claim 18 wherein the container comprises agitation means, to enable the contents of the container to be agitated.

21. The apparatus of claim 20 wherein the agitation means comprises an internal rotating paddle.

22. The apparatus of claim 20 wherein the agitation means comprises external fins mounted on the container, such that the container rotates in response to sea currents.

23. The apparatus of claim 17 wherein the container comprises a double skin, with a cavity between the skins which may be filled with air or sea water as desired, in order to adjust buoyancy.

24. The apparatus of claim 17 wherein the connection means comprises a flexible conduit for conveying drilling waste.

25. The apparatus of claim 24 wherein a plurality of flexible conduits are provided.

26. The apparatus of claim 17 further comprising a holding tank for holding drilling waste prior to conveying the waste to the container.

27. The apparatus of claim 17 further comprising a macerator.

28. The apparatus of claim 17 further including means for determining selected parameters of drilling waste.

29. The apparatus of claim 17 further comprising means for adding oil to the drilling waste.

30. The method of claim 17 wherein the container is made from flexible fabric.

31. An apparatus for use in storage and transport of drilling waste, the apparatus comprising a moveable container of adjustable buoyancy for containing drilling waste, the container having agitation means so as to allow the contents of the container to be agitated; securing means for releaseably securing the container, and connection means for connecting the container to a drilling platform of vessel.

32. The apparatus of claim 20 wherein the agitation means is an internal rotating paddle.

* * * * *